US008123252B2

(12) United States Patent
Lenhart

(10) Patent No.: US 8,123,252 B2
(45) Date of Patent: Feb. 28, 2012

(54) POLE GRIP WHICH CAN BE ADAPTED TO DIFFERENT HAND SIZES

(75) Inventor: Klaus Lenhart, Ohmden (DE)

(73) Assignee: Lekisport AG, Baar (CH)

( * ) Notice: Subject to any disclaimer, the term of this patent is extended or adjusted under 35 U.S.C. 154(b) by 433 days.

(21) Appl. No.: 12/373,200

(22) PCT Filed: Jul. 12, 2007

(86) PCT No.: PCT/CH2007/000337

§ 371 (c)(1),
(2), (4) Date: Jan. 9, 2009

(87) PCT Pub. No.: WO2008/011735

PCT Pub. Date: Jan. 31, 2008

(65) Prior Publication Data

US 2009/0250917 A1 Oct. 8, 2009

(30) Foreign Application Priority Data

Jul. 27, 2006 (CH) ..... 1224/06

(51) Int. Cl.
*A63C 11/22* (2006.01)

(52) U.S. Cl. ..... 280/821; 16/436

(58) Field of Classification Search ..... 280/821, 280/822; 16/436

See application file for complete search history.

(56) References Cited

U.S. PATENT DOCUMENTS 4,645,235 A * 2/1987 Joseph ..... 280/821

FOREIGN PATENT DOCUMENTS

DE 32 47 161 A1 6/1984
EP 0 044 588 A1 1/1982

* cited by examiner

*Primary Examiner* — J. Allen Shriver, II
*Assistant Examiner* — Erez Gurari
(74) *Attorney, Agent, or Firm* — Sughrue Mion, PLLC

(57) ABSTRACT

A stick handle is described, in particular for a ski stick, cross-country skiing stick, hiking stick or Nordic walking stick, with a handle body (10, 11), the head region (3) of which has, on the side (4) directed forwards in the direction of movement and/or on the side (5) directed rearwards in the direction of movement, an upper terminating projection (8, 12) which, when the stick is grasped, is arranged above the sliding hand and adjacent thereto, and which has, at least on the side (5) directed rearwards, a lower terminating projection (13) which, when the stick is grasped, is arranged below the grasping hand and adjacent thereto. With a handle of this type, adaptation to different hand sizes is made possible by the handle body being constructed from at least two individual stick handle elements (10, 11), wherein a first stick handle element (11) is connected in a form-fitting and/or frictional manner to the stick tube (1), and a second stick handle element (10) is arranged on the first stick handle element (11) in a manner such that it can be fixed in a displaceable and/or exchangeable manner.

22 Claims, 12 Drawing Sheets

POLE GRIP WHICH CAN BE ADAPTED TO DIFFERENT HAND SIZES

TECHNICAL FIELD

The present invention relates to an ergonomically configured pole grip, in particular for an alpine- or cross-country ski pole, hiking pole or Nordic walking pole. The grip comprises a grip body which, on the side which is directed forward as seen in the movement direction and/or on the side which is directed rearward as seen in the movement direction, has, in the head region, a top terminating protrusion which, when the user grips the pole, is arranged above the gripping hand and adjacent to the same. In addition, at least on the rearwardly directed side, such a grip has a bottom terminating protrusion which, when the user grips the pole, is arranged beneath the gripping hand and adjacent to the same.

PRIOR ART

In particular in the case of alpine ski poles, but equally also in the case of trekking poles, it is considered to be advantageous if the pole grip is configured ergonomically. On the one hand, this makes the pole more comfortable to grip and, on the other hand, it allows improved introduction of force by way of the hand in the axial direction in relation to the pole without the gripping force having to be excessively high.

Accordingly, there are a large number of grips which, on the side which is directed forward as seen in the direction of travel, have a depression for the forefinger, which is separated off from the gripping region of the rest of the fingers by a protrusion, and, on the side which is directed rearward as seen in the direction of travel, have a bottom terminating protrusion, on which the bottom edge of the hand can be supported for the introduction of force when the pole is used for pushing-off purposes. Such a construction is disclosed, for example, in German Utility Model DE 29 801 388 U1.

The problem with such an ergonomic configuration is that, depending on the hand size and shape, basically a different three-dimensional external shape would have to be provided in order for it to be possible to ensure optimum conditions. A first improvement in this respect has been made possible by the finding that only a depression for the forefinger is provided on the front side, rather than any further depressions being provided for the middle finger, the ring finger and the little finger, since these further depressions are immediately felt to be uncomfortable for different hand sizes if they are not positioned precisely correctly. U.S. Pat. No. 4,645,235 discloses a two-part pole grip which, by virtue of elements of different width being attached, can be adapted in terms of its thickness to different hand sizes.

DESCRIPTION OF THE INVENTION

Accordingly, the object of the invention is to provide an improved pole-grip design which is suitable in particular for different hand sizes or shapes. In particular the task is to improve a pole grip, in particular for an alpine- or cross-country ski pole, hiking pole or Nordic walking pole, having a grip body, wherein, on the side which is directed forward as seen in the movement direction and/or on the side which is directed rearward as seen in the movement direction, the grip body has, in the head region, a top terminating protrusion which, when the user grips the pole, is arranged above the gripping hand and adjacent to the same, and wherein provided at least on the rearwardly directed side is a bottom terminating protrusion which, when the user grips the pole, is arranged beneath the gripping hand and adjacent to the same.

This object is achieved in that the grip body is constructed from at least two individual pole-grip elements, wherein a first pole-grip element is connected to the pole shaft in a form-fitting and/or force-fitting manner, such that no movement can take place, and a second pole-grip element is arranged on the first pole-grip element such that it can be displaced and secured and/or exchanged, and this therefore allows adaptation to different hand sizes.

The core of the invention is thus to construct the pole grip from two elements which can be secured in different positions relative to one another. The two elements can be secured in different positions here such that adaptation to different hand sizes or to use with/without a glove is made possible. In particular it is possible to allow for even very large differences, for example to allow simultaneously for the possibility of adaptation to a child's hand and to an adult's hand. In other words, the pole grip provided is one which virtually "grows" with the user. According to a first preferred embodiment of the pole grip, the latter is characterized in that the first pole-grip element forms the head region and the forwardly directed region, and the second pole-grip element is arranged on the side which is directed rearward as seen in the movement direction. The second pole-grip element here preferably comprises the bottom, rearwardly directed terminating protrusion. The second pole-grip element preferably forms, at least in part, the rearwardly directed grip region of the pole grip. The second pole-grip element is thus essentially L-shaped, in that the second pole-grip element forms preferably both the bottom region of the rearwardly directed grip region of the pole grip, which ends up to be located in the palm of the user's hand, and the terminating protrusion which projects rearward from the rearwardly directed grip region, and at least partially engages around and/or supports the bottom edge of the user's hand. The rearwardly directed terminating protrusion is preferably formed integrally with the rearwardly directed grip region of the pole grip or formed fixedly thereon. As a result of the second grip element being adjusted in terms of height in the axial direction parallel to the pole axis, it is thus the case that both, in part, the rearwardly directed grip region of the pole grip and the rearwardly projecting terminating protrusion are displaced together. If the second pole-grip element is displaced downward, then the size of the grip can be adapted to a larger hand since the rearwardly directed terminating protrusion is displaced downward and makes space in the axial direction for a larger hand. As a result of the first pole-grip element being partially overlapped by the second pole-grip element, displacement of the second pole-grip element axially downward results in regions of the first pole-grip element being exposed and upward displacement, i.e. for adaptation to a smaller hand size, results in those regions of the first pole-grip element being covered over again, wherein, when the second pole-grip element is displaced upward, bottom regions of the first pole-grip element are exposed again. The rearwardly directed shoulder, moreover, is particularly suitable as a point of engagement for the displacement of the second pole-grip element since it is easy to grip the shoulder.

This special construction, on the one hand, has proven to be particularly straightforward in design terms and, on the other hand, it allows the largest possible adjustment range. The concept is based on the fact that, as it were, the axial position of the hand, by virtue of the position of the forefinger in the depression at the front, is defined by the first pole-grip element irrespective of the hand size. The problem with the prior-art grips, then, is that, in the case of a hand being too small for the pole grip, the bottom rear terminating protrusion, on which the bottom edge of the hand should rest when the pole is used efficiently for pushing-off purposes, is arranged at a point remote from the hand. According to the invention, then, it is precisely this bottom rear terminating protrusion which is configured to be axially adjustable, that is to say it can easily be displaced upward, virtually, from a bottom position for very large hands until it ends up to be located comfortably on the bottom edge of the user's hand and, accordingly, allows the pole to be used efficiently for pushing-off purposes and makes the pole comfortable to grip. This can be realized particularly advantageously in design terms if the second pole-grip element forms, at least in part, the rearwardly directed grip region of the pole grip.

A further-preferred embodiment is thus characterized in that the second pole-grip element is mounted such that it can be displaced in stepless, i.e. continuous, fashion, or secured in discrete positions, in relation to the first pole-grip element in a direction essentially parallel to the main axis of the pole grip. The second pole-grip element here is preferably mounted such that it can be displaced via an adjusting screw mounted in the first pole-grip element. This adjusting screw may be arranged essentially axially in relation to the axis of the pole grip. It preferably comprises a screw of which it is not possible to change the axial position within the first pole-grip element, and it also comprises a threaded element which runs, on or in the second pole-grip element, on the thread of this screw and may be formed integrally with the second pole-grip element or may be in the form of a separate component.

There are preferably two different possibilities here: a first possibility, in which the screw is arranged in a rotationally fixed manner and a rotatable mating element is present on the second pole-grip element; or virtually a converse situation where the screw is arranged in a rotatable manner and a rotationally fixed mating element is present on or in the second pole-grip element.

Accordingly, a further embodiment is characterized in that the screw is arranged in a rotationally fixed manner in the first pole-grip element, and in that the threaded element is an adjusting nut (for example a knurled nut) which is arranged in or on the second pole-grip element such that it can be rotated but is fixed axially relative to the second pole-grip element. When the adjusting nut is rotated here, there is a change in the axial position of the second pole-grip element relative to the first pole-grip element. The adjusting nut here is accessible in particular preferably from the outside in that region on which the palm of the hand ends up to be located, but it is also possible for this adjusting nut to be arranged in an accessible manner at some other location.

The alternative embodiment is characterized in that the screw is arranged in a rotatable manner in the first pole-grip element, and in that the threaded element is a rotationally fixed thread in the second pole-grip element (this rotationally fixed thread may be in the form of a separate component or may be formed in the material of the second pole-grip element, for example as an internal thread), wherein, when the screw is rotated, there is a change in the axial position of the second pole-grip element relative to the first pole-grip element. The screw is preferably accessible here from the bottom beneath the second pole-grip element or from above in the region of the head.

A further-preferred embodiment is characterized in that the second pole-grip element can be secured in different axial positions in relation to the first pole-grip element via at least one fixing screw (preferably two such fixing screws are provided in an axially offset manner) which is arranged essentially perpendicularly (that is to say usually radially) in relation to the main axis of the pole grip and passes through a hole through the second pole-grip element. The first pole-grip element here preferably contains an essentially axially oriented guide recess in which at least one mating nut (e.g. in the form of a square element), and preferably two of these nuts, is or are mounted in an axially displaceable but rotationally fixed manner, and in that the at least one fixing screw engages in the thread of this mating nut. It is basically also possible for the first pole-grip element to contain at least two discretely positioned mating threads for the fixing screws, and the second pole-grip element can therefore be secured in discrete axial positions.

In order for it to be possible to ensure, in the case of such a variable-fastening method, that the two elements are fastened such that they cannot be displaced relative to one another, it may prove to be advantageous, according to a preferred embodiment, if the first pole-grip element and the second pole-grip element have a toothing formation, and these toothing formations, by engaging one inside the other, enhance the axial securing action of the two elements in relation to one another and allow more or less stepless adjustability.

According to a further alternative preferred embodiment, the position of the second pole-grip element relative to the first pole-grip element can be secured via at least one transverse pin, the at least one transverse pin preferably being mounted in a transverse hole in the first pole-grip element and/or in a transverse hole in the second pole-grip element. It is preferred here if the first pole-grip element has an axial tongue, at least in a bottom region, and the second pole-grip element has a corresponding axial groove extending, at least in part, over the length of the second pole-grip element, or if the first pole-grip element has an axial groove and the second pole-grip element has a corresponding axial tongue. In addition, it is advantageous if the axial tongue contains, at different heights, i.e. in an axially offset manner, at least two or three holes and/or apertures through which the transverse pin can pass and it is thus possible to secure the axial position of the second pole-grip element on the first pole-grip element. It is preferred if the first pole-grip element has an axial groove and the second pole-grip element has a corresponding axial tongue, wherein the axial groove has at least one additional undercut and the axial tongue has at least one additional widened portion. Preferably both the axial groove and the axial tongue are T-shaped, the lateral undercuts of the groove and the widened portion of the tongue on both sides making up the crossbar of the letter T. The axial groove of the first pole-grip element may be open in the downward direction and is suitable for accommodating, preferably from beneath, an axial tongue arranged in a bottom region of the second pole-grip element. Furthermore, preferably in a region which bounds the axial groove laterally, the first pole-grip element has at least two axially offset, virtually tangential holes, and the second pole-grip element has a (single) tangential hole which, when the second pole-grip element is positioned at the desired adjustment height, ends up to be located coaxially in relation to the tangential hole of the first pole-grip element. According to a further preferred embodiment, the transverse pin, which is inserted when the second pole-grip element has been placed in position, projects twice through the first pole-grip element and three times through the second pole-grip element, wherein, in the second pole-grip element, the transverse pin projects once through the axial tongue.

A further-preferred embodiment is characterized in that the first pole-grip element forms the head region and the forwardly directed region, and the second pole-grip element is arranged on the side which is directed rearward as seen in the movement direction, in that the second pole-grip element comprises the bottom, rearwardly directed terminating protrusion, in that the second pole-grip element forms, at least in part, the rearwardly directed grip region of the pole grip, and in that the first pole-grip element has axially running lateral guide grooves, and the second pole-grip element has corresponding guide ribs which engage in these guide grooves. Preferably, according to another embodiment, the first pole-grip element forms the bottom region of the pole grip and has at least the bottom terminating protrusion, and the second pole-grip element forms the top region of the pole grip and has at least the top terminating protrusion.

A further possible embodiment is characterized in that the second pole-grip element is designed to be exchangeable and can be fitted and/or inserted in different colors and/or materials and/or external shapes. It is thus possible, for example, to provide hard or soft elements, depending on the customer's requirements or usage (with or without gloves), it being possible for the different material properties to be rendered recognizable via different colors. In addition, it is also possible to provide different external shapes in order to allow even better adaptation to different hand geometries, color coding being possible in this case too.

Typically, the first pole-grip element and/or the second pole-grip element consist/consists of plastic material, cork or wood or a combination of these materials, it also being possible, in addition, to provide (in certain regions) grip-enhancing coatings.

Further preferred embodiments of the invention are described in the dependent claims.

BRIEF EXPLANATION OF THE FIGURES

The invention shall be explained in more detail hereinbelow, by way of exemplary embodiments, in conjunction with the drawings, in which:

FIG. 7 shows a seventh exemplary embodiment, wherein FIGS. 7*a-c* illustrate different views (view from the front, lateral view, view from behind) of a pole grip according to the invention, FIG. 7*d* illustrates a section along line A-A and FIG. 7*e* illustrates a section along line B-B. FIG. 7*f* shows a view of the pole grip from above and FIG. 7*g* shows a bottom view of the pole grip. In FIGS. 7*a*-7*e*, the adjustable second pole-grip element is set in the uppermost of three possible adjustment positions.

FIGS. 8*a-c* show different views (view from the front, lateral view, view from behind), wherein FIG. 8*d* shows a section through line C-C and FIG. 8*e* shows a section through line D-D.

FIGS. 9*a-c* show three different views (view from the front, lateral view, view from behind) of the pole grip, wherein FIG. 9*d* illustrates a section through line E-E and FIG. 9*e* illustrates a section through line F-F.

WAYS OF IMPLEMENTING THE INVENTION

The invention as defined in the appended claims shall be explained hereinbelow with reference to a number of exemplary embodiments. The exemplary embodiments here should be interpreted only as illustrating the invention and not as restricting the scope of protection as defined in the claims.

Figure 1:
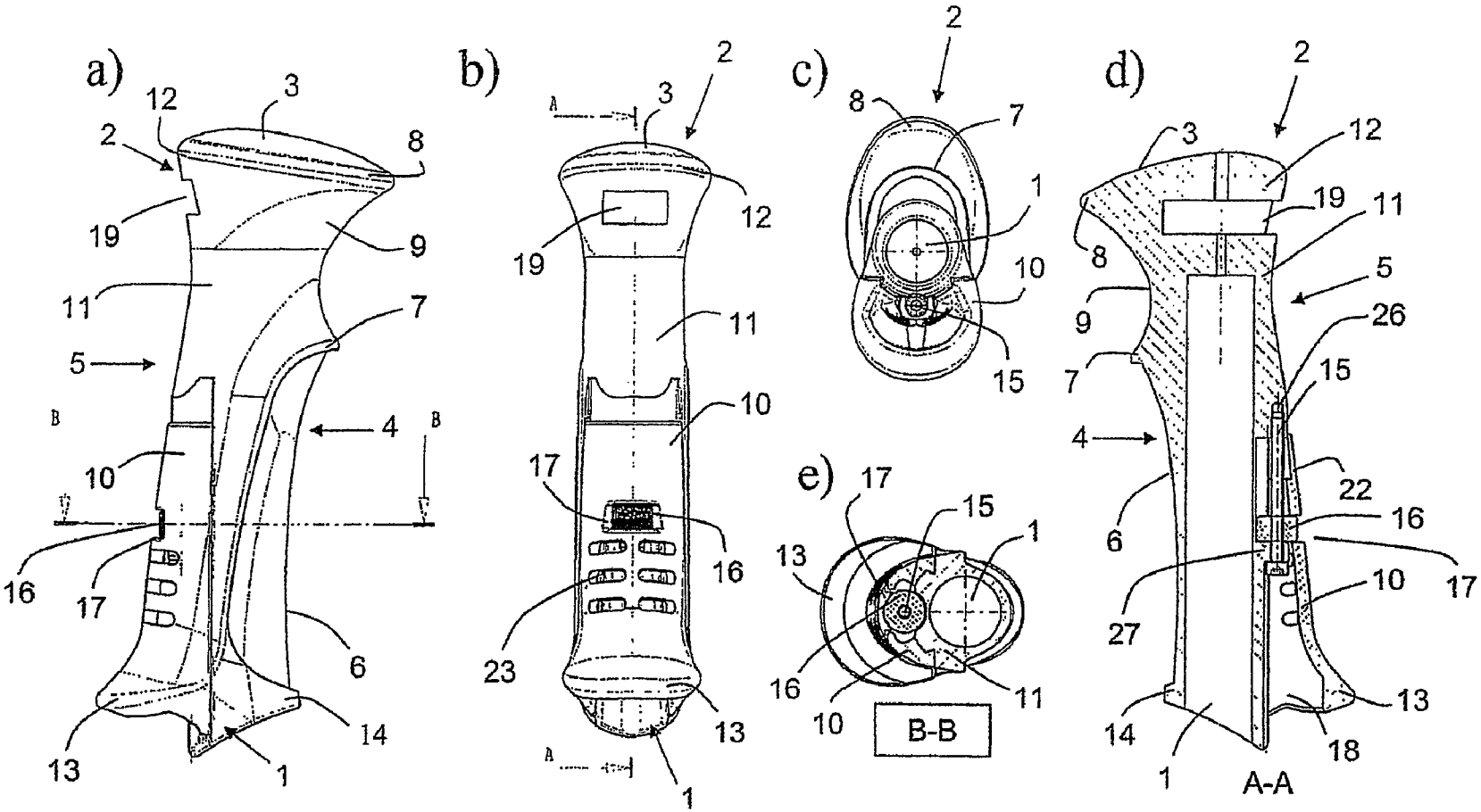
FIG. 1 shows different views of a first exemplary embodiment of a pole grip, wherein figures a)-e) illustrate the pole grip in a situation where the second pole-grip element is secured in the lowermost position, i.e. for a maximum hand size, wherein a) illustrates a lateral view, b) illustrates a view from behind, c) illustrates a view from beneath, d) illustrates a section along line A-A in FIGS. 1*b*), and *e*) illustrates a section along B-B (in FIG. 1*a*), wherein FIGS. 1*f*)-*i*) illustrate such a pole grip in a situation where the second pole-grip element is secured in a middle position, wherein f) illustrates a lateral view, g) illustrates a view from behind, h) illustrates a section along line C-C (in FIGS. 1*g*) and *i*) illustrates a section along line D-D (in FIG. 1*f*), and wherein FIGS. 1*k*)-*m*) illustrate such a pole grip in a situation in which the second pole-grip element is illustrated in its uppermost position, i.e. for a small hand, wherein k) illustrates a lateral view, l) illustrates a view from behind and m) illustrates a section along line E-E (in FIG. 1*l*)
Figure 1:
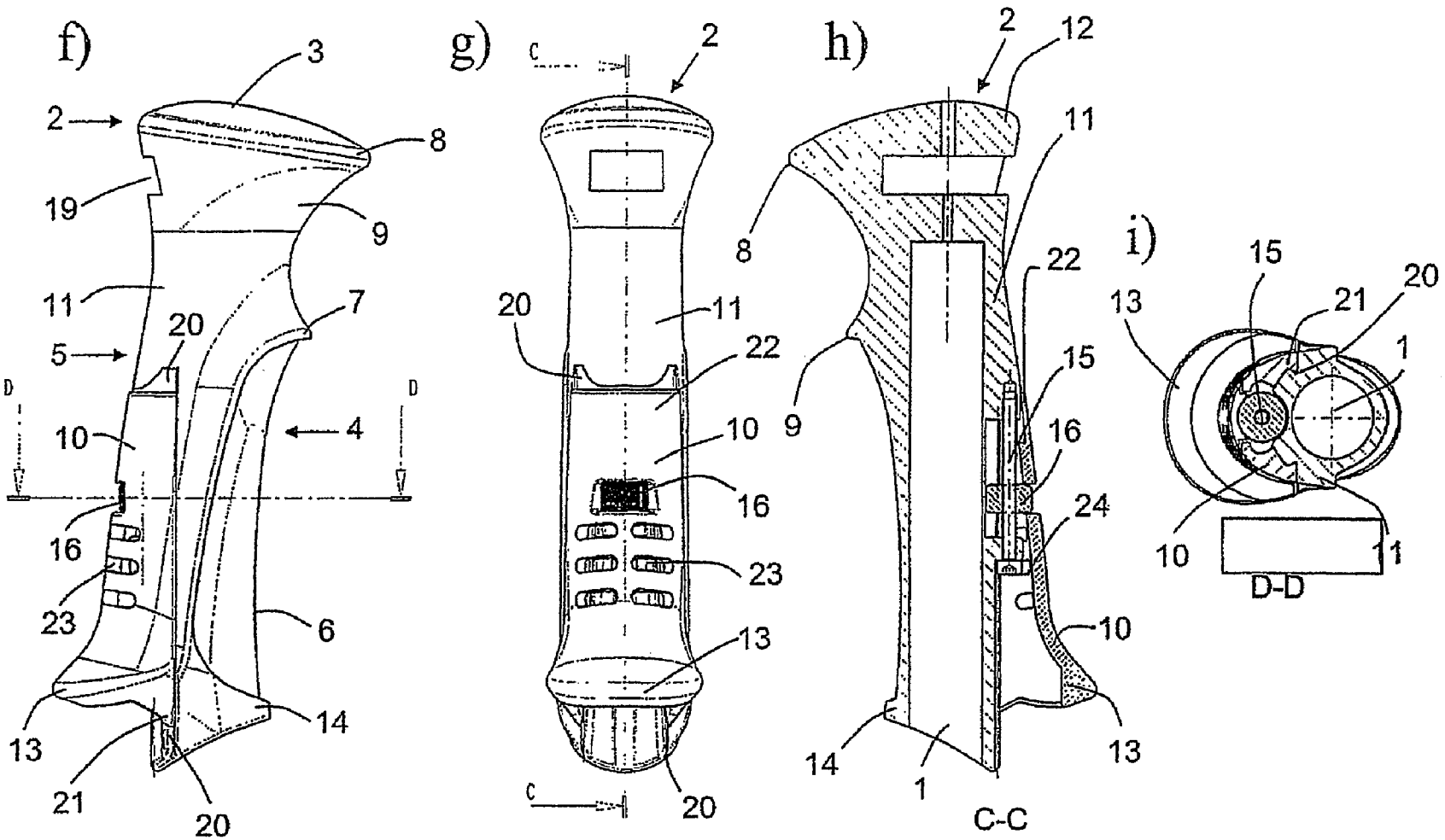
Figure 1:
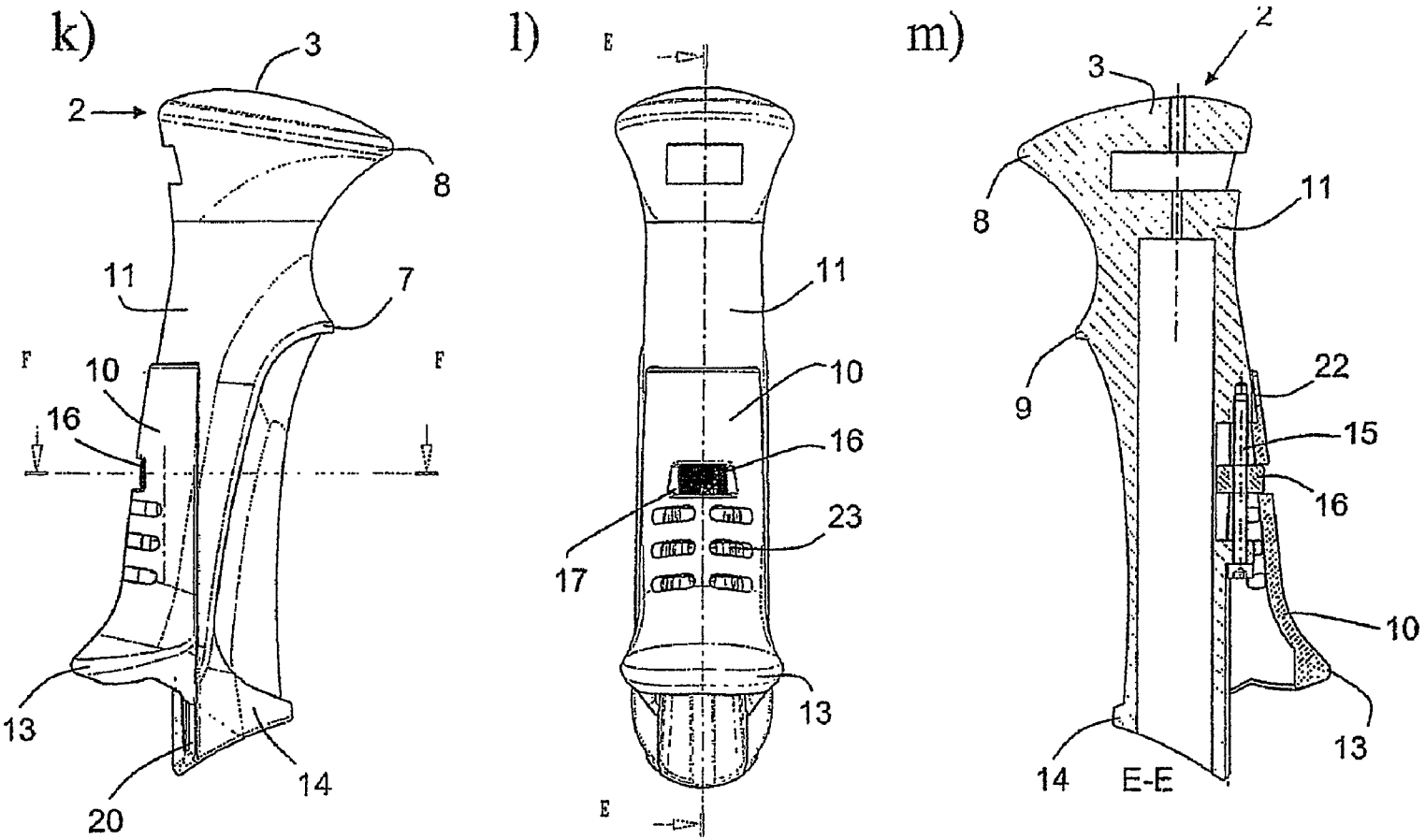

FIG. 1 illustrates a first exemplary embodiment. FIGS. 1*a*)-*e*) here illustrate that position in which the pole grip is set for a maximum hand size.

The pole grip 2 comprises a grip body which has, on its underside, a recess 1 for a pole shaft (not illustrated). Usually a tip and possibly a basket are arranged at the other end of the pole shaft. The pole grip 2 here is configured ergonomically, i.e. it has in the head region 3, on the front side 4, a top terminating rib or, rather, a top terminating protrusion 8, which prevents the pole from being able to slide rearward out of the hand gripping it, for example as the arm is brought forward. This is followed in the downward direction by a front grip region 9, which is separated off from the front grip region 6 for the middle finger, ring finger and little finger by a rib or a protrusion 7. At the very bottom, the pole grip is delimited on the front side usually by a bottom terminating rib 14.

Such a pole grip is already suitable to a certain extent for different hand sizes in that only a single rib 7 is arranged on the front side between the fingers, that is to say between the forefinger and middle finger.

On the rear side 5, the pole grip has a top terminating rib 12, which is not usually particularly pronounced, in the head region 3 and a normally very pronounced bottom terminating rib 13, which allows, in particular, the efficient introduction of force when the pole is used for pushing-off purposes and also provides a good rest for the hand in order that the pole can be better controlled. In addition, the pole grip has, in its head region 3, in this case a recess 19 for a hand strap. It is also possible, however, for a fixing mechanism to be arranged in this region, for example one constructed as described in EP 1 036 579 or in WO 2004/052476 or EP 0 925 099. The essential factor, then, inter alia, is that the pole grip is constructed from two individual pole-grip elements. There is a first pole-grip element 11, which is fastened on the pole shaft and/or contains the recess 1, already mentioned in the introduction, for the pole shaft. This first pole-grip element 11 forms the entire front region and the head region and, in these regions, is directly enclosed by the hand. A second pole-grip element 10 is then arranged on the bottom rear side 5. This second pole-grip element is designed such that it forms the rear bottom region of the pole grip and is also enclosed there by the gripping hand. In particular the bottom terminating rib, or the bottom terminating protrusion 13, is a constituent part of this variable and/or displaceable second pole-grip element 10. In the case of this first exemplary embodiment, the position of this second pole-grip element 10 can be displaced axially via a mechanism which will be described hereinbelow, i.e. it can be displaced in stepless fashion from the lowermost position, which is illustrated in figures a)-e), into higher positions, i.e. into a central position (FIGS. 1*f*)-*i*)) and an uppermost position (FIGS. 1*k*)-*m*)).

For this purpose, the second pole-grip element 10 is designed as a hollow-profile-like element which at least partially encloses the first pole-grip element virtually in a U-shaped manner. It has, on the two side flanks, inwardly directed guide ribs 21 which engage in corresponding, laterally exposed guide grooves 20 in the first pole-grip element 11 such that the second pole-grip element can be displaced axially in relation to the pole shaft, or in relation to the pole grip, respectively.

In the first pole-grip element, an axial screw 15 is fastened coaxially to the pole shaft. It has its tip recessed in a top guide hole and has its bottom region retained in a bottom guide 27. The screw 15 has a screw head (in this case in the form of a hexagon socket) at the bottom and, in the region above, this screw 15 has an external thread. The screw is fastened in a rotationally fixed manner on the first pole-grip element, i.e. the screw can only be released from its fastening in the first pole-grip element if force is applied specifically via the screw head.

The central region of this screw is virtually exposed and serves as a guide means for the adjusting nut 16. The adjusting nut 16 is provided with an internal thread and is preferably structured as a knurled nut. The knurled nut preferably has a grip-enhancing surface; this can be ensured, for example, by an appropriate selection in respect of material or coating (e.g. rubber) or by grooves, protuberances or hollows or the like. Accordingly, the adjusting nut 16 can be secured axially via rotation. The second pole-grip element, which is guided in the guide grooves 20, has an aperture 17, through which the adjusting nut passes out, at least in part, and which couples, in particular, the axial position of the adjusting nut 16 to the axial position of the second pole-grip element 10.

The adjusting nut 16 can be actuated correspondingly through the aperture 17, which virtually forms an actuating window. If, then, this actuating nut 16 is rotated, it moves out of a bottom position a)-e) in the first instance into a middle position, the second pole-grip element 10 being carried along in the process. This middle position is illustrated in FIGS. 1*f*)-*h*).

If the adjusting nut 16 is rotated further, then the adjusting nut 16, accompanied synchronously by the second pole-grip element 10, is displaced onward to the uppermost position, which is illustrated in FIGS. 1*k*)-*m*).

In order to be able to cover this entire range, the second pole-grip element 10 has a top covering region 22 which for example, as is illustrated in FIG. 1*m*), can merge, via a bottom shoulder, into a stop for the uppermost position.

As can be gathered, in particular, from the series of FIGS. 1*a*)-*f*) and *k*), the displacement of the second pole-grip element 10 relative to the first pole-grip element 11 gradually reduces, in particular, the axial spacing between the top forwardly directed terminating protrusion 8 and the bottom rear terminating protrusion 13. Since these two protrusions are essential in order for the pole to be comfortable to grip and to provide efficient gripping, it is correspondingly possible, via the adjustability of the positioning of these two protrusions relative to one another, to cover an extraordinarily wide range of hand sizes. This is because studies have demonstrated that the position of the protrusion 7 in this respect is less critical. It is therefore the case, in other words, that the pole grip in the position as is illustrated in FIGS. 1*a*)-*e*) is suitable for accommodating large hands or hands with large-volume gloves, the pole grip in the position as in figures f)-i) is suitable for an average hand size, and the position as in figures k)-m) is suitable for small hands. It is thus possible, for example, for a pole grip to grow along with a child's hand and for the second pole-grip element 10 to be displaced gradually from the uppermost position into the lowermost position as the hand grows.

Figure 2:
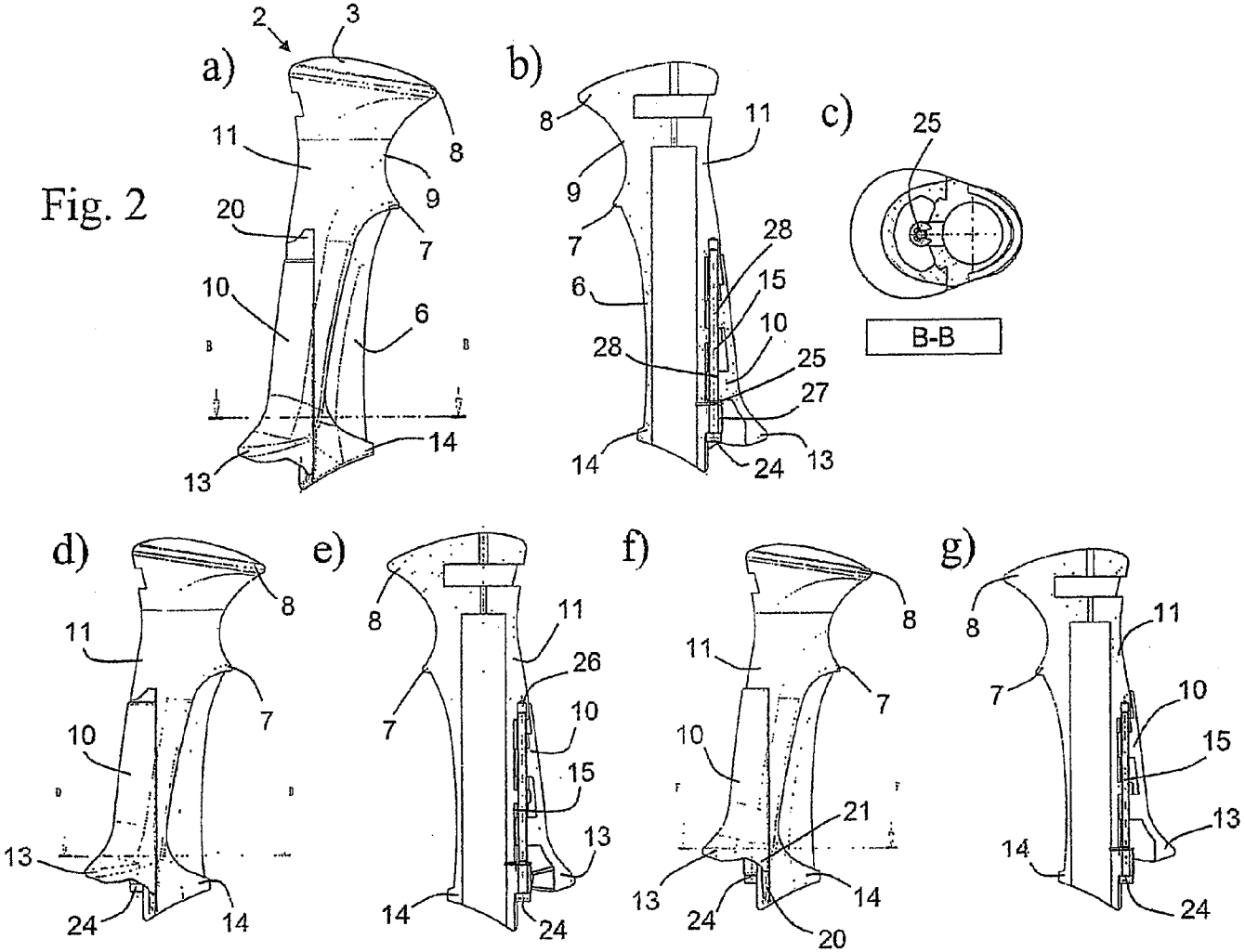
FIG. 2 shows a further exemplary embodiment, wherein a)-c) illustrate the pole grip in a situation in which the second pole-grip element is secured in the lowermost position, wherein a) illustrates a lateral view, b) illustrates an axial section as seen in the direction of travel and c) illustrates a section along line B-B in FIG. 2*a*), wherein d)-e) illustrate the pole grip in a situation in which the second pole-grip element is illustrated in a middle position, wherein d) illustrates a lateral view and e) illustrates an axial section as seen in the direction of travel, and wherein f)-g) illustrate the pole grip in a situation in which the second pole-grip element is secured in the uppermost position, wherein f) illustrates a lateral view and g) illustrates an axial section as seen in the direction of travel.

A further exemplary embodiment with a similar construction is illustrated in FIG. 2. This figure likewise contains an axial screw 15, but the latter is then mounted in a rotatable, rather than rotationally fixed, manner in the first pole-grip element 11. It likewise has an external thread in the top region and a screw head at the bottom end. The second pole-grip element 10, in this case, has two threaded regions (one threaded region would also be possible), i.e. the element 10 has an internal thread bored in it in the regions 28. Otherwise, the second pole-grip element 10 is very similar to that in FIG. 1, with the exception that, in the case of this exemplary embodiment, there are no ventilation holes provided and the bottom cavity 18, on account of the different construction, is significantly smaller.

In the case of this second exemplary embodiment, then, the second pole-grip element 10 can be displaced from its lowermost position (FIGS. 2*a*)-*c*)) into the central position (FIGS. 2*d*)-*e*)) and as far as the uppermost position (FIGS. 2*f*)-*g*)) by virtue of a tool, in this specific case a hexagon-socket wrench, being used to rotate the screw 15 via the screw head 24. As a result of the internal thread 28 on the second pole-grip element 10, the rotation of this screw causes the pole-grip element 10 to be gradually displaced since, as a result of its construction, the second pole-grip element can be displaced in the guide grooves 20, by way of the guide ribs 21, only in the axial direction.

Figure 3:
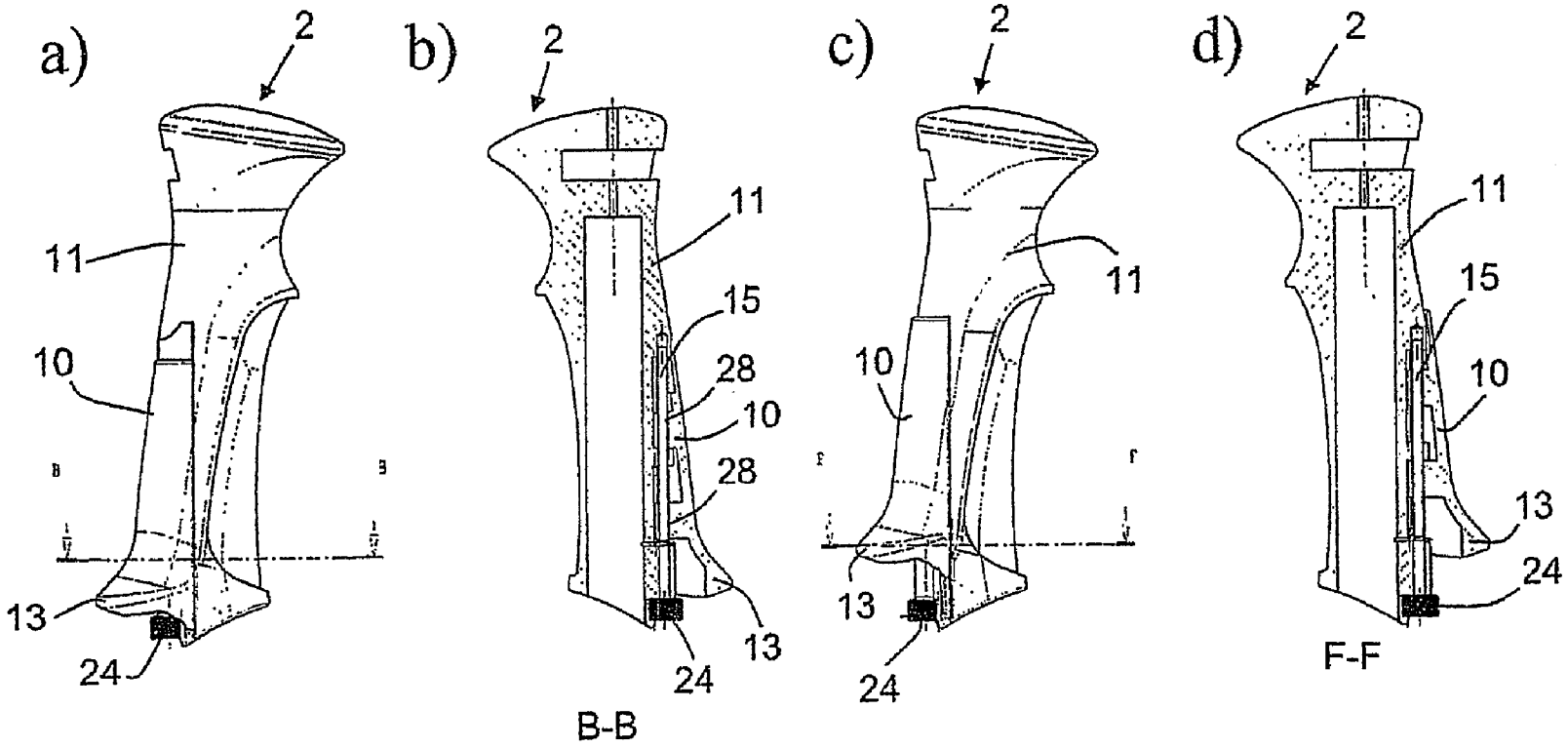
FIG. 3 shows a third exemplary embodiment, wherein a) (view from the side) and b) (axial section as seen in the direction of travel) illustrate a situation in which the second pole-grip element is secured in the lowermost position, and c) (lateral view) and d) (axial section in the direction of travel) illustrate a situation in which the second pole-grip element is secured in its uppermost position.

FIG. 3 illustrates a third exemplary embodiment, which differs from the exemplary embodiment according to FIG. 2 essentially only in that, instead of the screw head 24 being more or less concealed in the cavity 18, this screw head 24 is designed as a relatively large knurled screw head which can be actuated manually from the outside. This increases the ease of adjustment.

Figure 4:
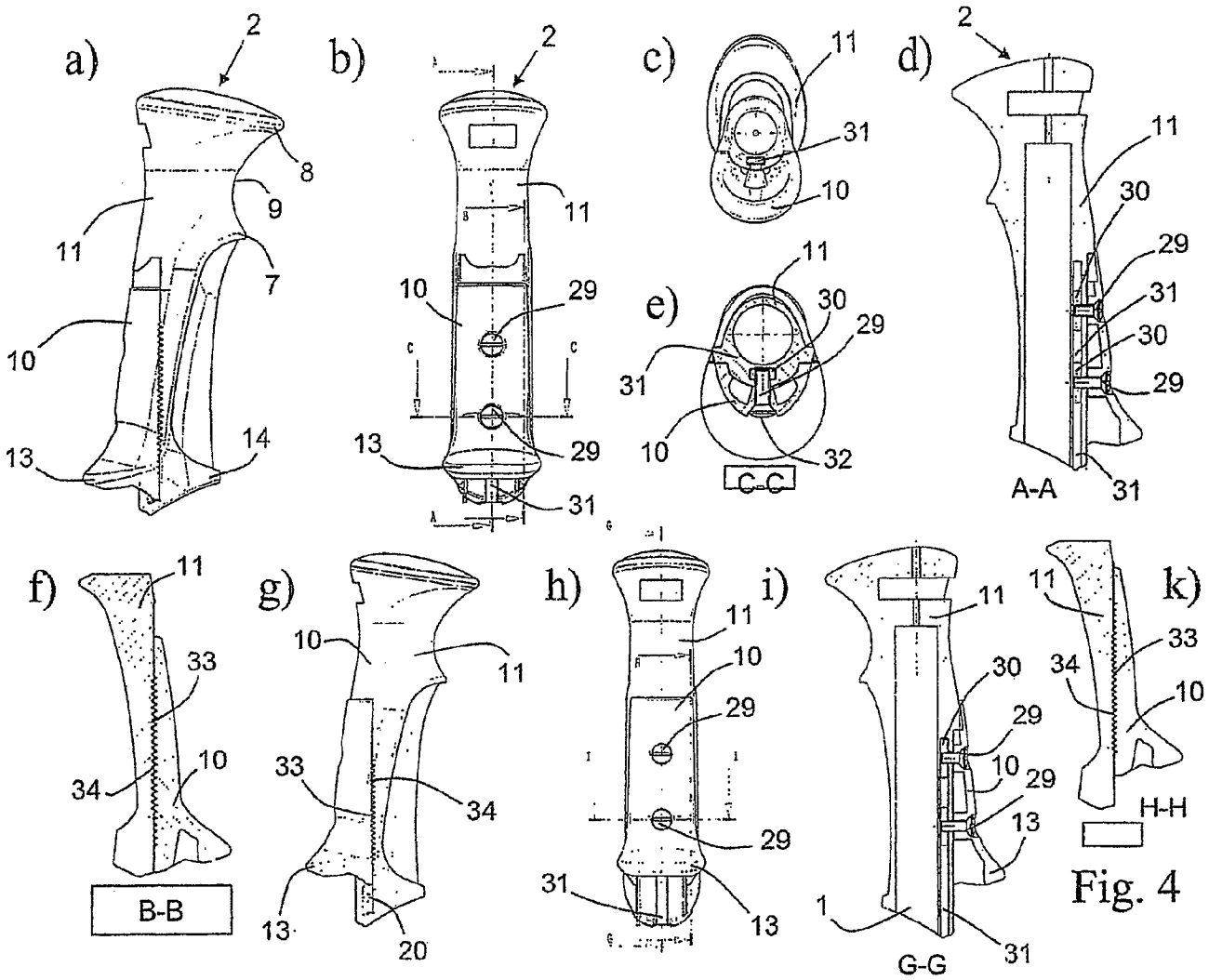
FIG. 4 shows a fourth exemplary embodiment, wherein a)-f) illustrate the pole grip in a situation in which the second pole-grip element is secured in the lowermost position, wherein a) illustrates a lateral view, b) illustrates a view from behind, c) illustrates a view from beneath, d) illustrates a section along line A-A in FIGS. 4*b*), *e*) illustrates a section along line C-C in FIGS. 4*b*) and *f*) illustrates a section along line B-B in FIG. 4*b*), and wherein figures g)-k) illustrate the pole grip in a position in which the second pole-grip element is secured in the uppermost position, wherein g) illustrates a lateral view, h) illustrates a view from behind, i) illustrates a section along line G-G) (in FIGS. 4*h*) and *k*) illustrates a section along line H-H (in FIG. 4*h*)

FIG. 4 illustrates a fourth exemplary embodiment, wherein a)-f) illustrate the lowermost position of the second pole-grip element 10 and g)-k) illustrate the uppermost position of the second pole-grip element 10, i.e. that position which is best suited for small hands.

In the case of this exemplary embodiment, rather than an axial screw being used, the second pole-grip element 10 is fixed on the first pole-grip element 11 by virtually radial screws 29. Otherwise, here too, the second pole-grip element has guide ribs 21 which engage in the axial guide grooves 20 in the first pole-grip element and thus guide the second pole-grip element 10 axially.

In order to ensure a virtually stepless, i.e. continuous, axial adjustability, this design has an axial guide recess 31 provided in the first pole-grip element. This guide recess is a guide groove which is undercut laterally on both sides and into which square mating nuts 30 are pushed from beneath. Accordingly, these mating nuts 30 can be displaced axially in this guide recess 31, but they cannot rotate. In addition, the opening with the internal thread is accessible from the front by way of the slot of the guide recess.

The second pole-grip element 10, then, has two holes which are arranged in an axially offset manner. Two screws 29 are guided through these holes, and the screws engage in the internal thread in the mating nuts 30. Using a tool to release these screws 29 slightly then allows the second pole-grip element 10 to be displaced axially relative to the first pole-grip element 11.

Since it is often necessary, in the case of such a design, to ensure the axial displaceability as far as possible without the screws 29 being secured to an excessive extent, it may prove to be advantageous to provide a respective toothing formation 33 or 34, respectively, on facing edges/surfaces on the first pole-grip element, for example on the outer periphery of the latter (also possible on the inside) and, correspondingly, on the second pole-grip element, likewise on the outer periphery. As a result, even when the screws 29 are not tightened to the full extent, axial displacement of the element 10 relative to the element 11 is not possible. This is extremely advantageous in view of the large axial forces at play when the pole is used for pushing-off purposes. It is only when the screw is released over the displacement height of the toothing formation that axial displacement can actually take place, and more or less stepless adjustment is still possible.

Figure 5:
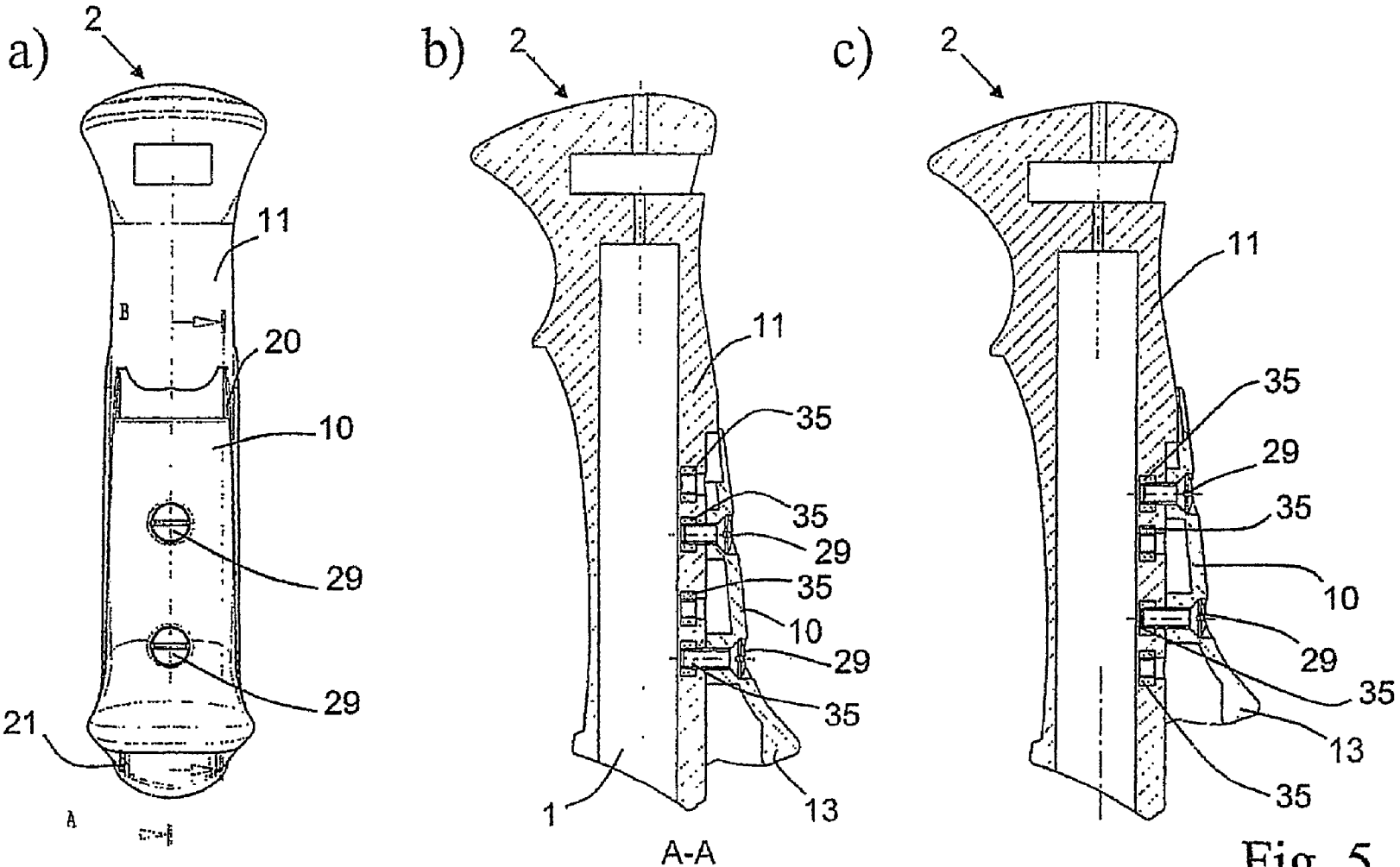
FIG. 5 shows a fifth exemplary embodiment, wherein FIGS. 5*a*) (view from behind) and *b*) (section along line A-A in FIG. 5*a*) illustrate the pole grip in a situation in which the second pole-grip element is secured in the lowermost position, and c) illustrates an axial section in a situation in which the second pole-grip element is secured in the uppermost position.

FIG. 5 illustrates a further exemplary embodiment, which is similar to that illustrated in FIG. 4. In this case, however, rather than any stepless, i.e. continuous, axial adjustability, provision is made only for adjustability in discrete positions. For this purpose, two or more pairs of individual mating nuts 35 are recessed in the first pole-grip element 11, and fixing screws 29 engage therein. As can be gathered from the illustration of the bottom position according to FIG. 5*b*), in this case the screws, in the bottom position, engage in the two bottom holes 35, whereas the top pair of holes remains unused. Should the second element 10 be shifted from the bottom position according to FIG. 5*b*) into the uppermost position according to FIG. 5*c*), then it is necessary for the screws 29 to be completely unscrewed from the mating nuts 35, for the second pole-grip element to be displaced upward and for the two fixing screws to be screwed into the top two individual mating nuts. Only two discrete positions are illustrated in this case, but it would, of course, also be possible to provide three or even four such discrete positions by way of corresponding individual mating nuts or holes with an internal thread in the first pole-grip element 11. Here too, it is advantageous, although not necessary to the same extent, to provide a toothing formation as has been described in conjunction with FIG. 4.

In the case of the two exemplary embodiments according to FIGS. 4 and 5, it is possible in a particularly straightforward manner for the second pole-grip element 10 also to be configured such that it can be exchanged. It is therefore possible to provide this rear shell 10 in different materials (for example with different levels of hardness), with different colors (identification of different materials and/or different shapes) and/or with different shaping, which further increases the adaptability. It is then possible to include a number of such shells 10 at the point of sale or to selectively buy different shells 10.

Figure 6:
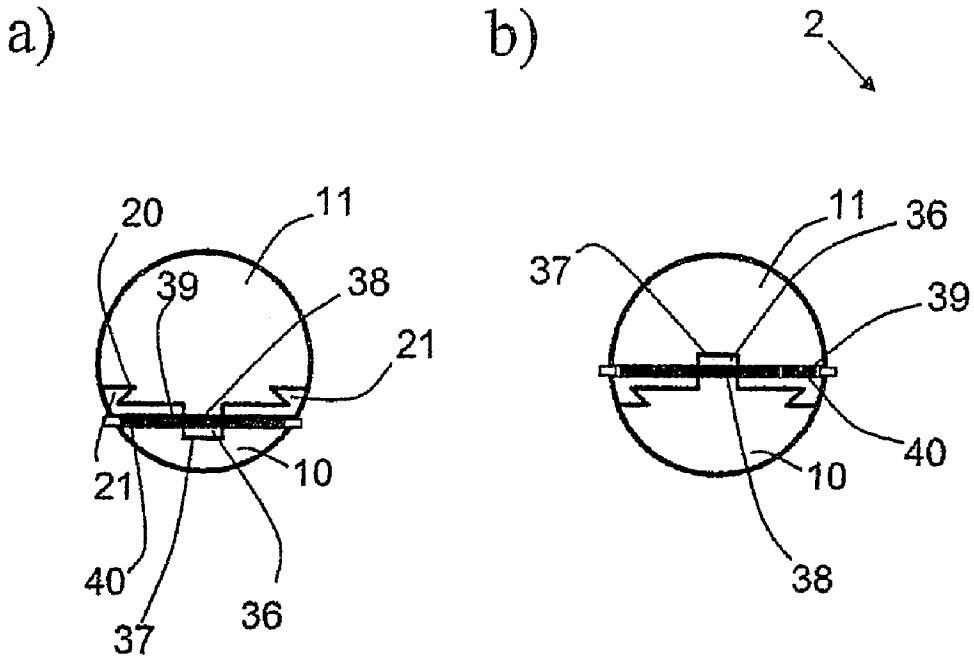
FIG. 6 shows a sixth exemplary embodiment, wherein two different shapes are illustrated in the two figures a) and b), each showing a sectional illustration taken perpendicular to the axis of the pole grip.

A further embodiment is illustrated in FIG. 6. In this case, the second pole-grip element 10 is adjusted axially via a transverse pin 40. As can be seen in FIG. 6*a*), according to a first exemplary embodiment of this construction, the second pole-grip element 10 has an axial groove 37, alongside the laterally arranged guide rib 21. Correspondingly, the first pole-grip element 11 has an axial tongue 36, which engages in the axial groove 37. The groove and tongue do not have any further structuring in FIG. 6*a*), but it is also possible for example for the groove and the tongue to be of undercut configuration.

The second pole-grip element 10, then, has a transversely running hole 39. It is also possible to provide two such holes 39 in an axially offset manner. Equally, the tongue 36 has holes 38. The tongue 36 here has a plurality of (at least two) such holes 38 of different axial heights. It is also possible here for the holes 38 to be configured as U-shaped apertures which are open toward the side of the shell 10.

If, in the case of such a design, the height of the second pole-grip element 10 is to be changed, then in the first instance the transverse pin 40 is removed (for example with the aid of a sharp or pointed object) or pushed out of the holes 38/39. Thereafter, the second pole-grip element 10 can be displaced axially. It can then be displaced upward or downward and the transverse pin 40 can then be pushed in again, in which case it passes through the same hole 39 in the second pole-grip element 10 but through a different hole 38 in the tongue 36. This provides a particularly straightforward, but very robust, design.

Conversely, as it were, an analogous design as is illustrated in FIG. 6*b*) is also possible. In this case, the second pole-grip element 10 has the tongue 36 and the first pole-grip element 11 has the corresponding axial groove 37. In this case, the transverse pin 40 is mounted in a hole 39 in the first pole-grip element 11.

Figure 7:
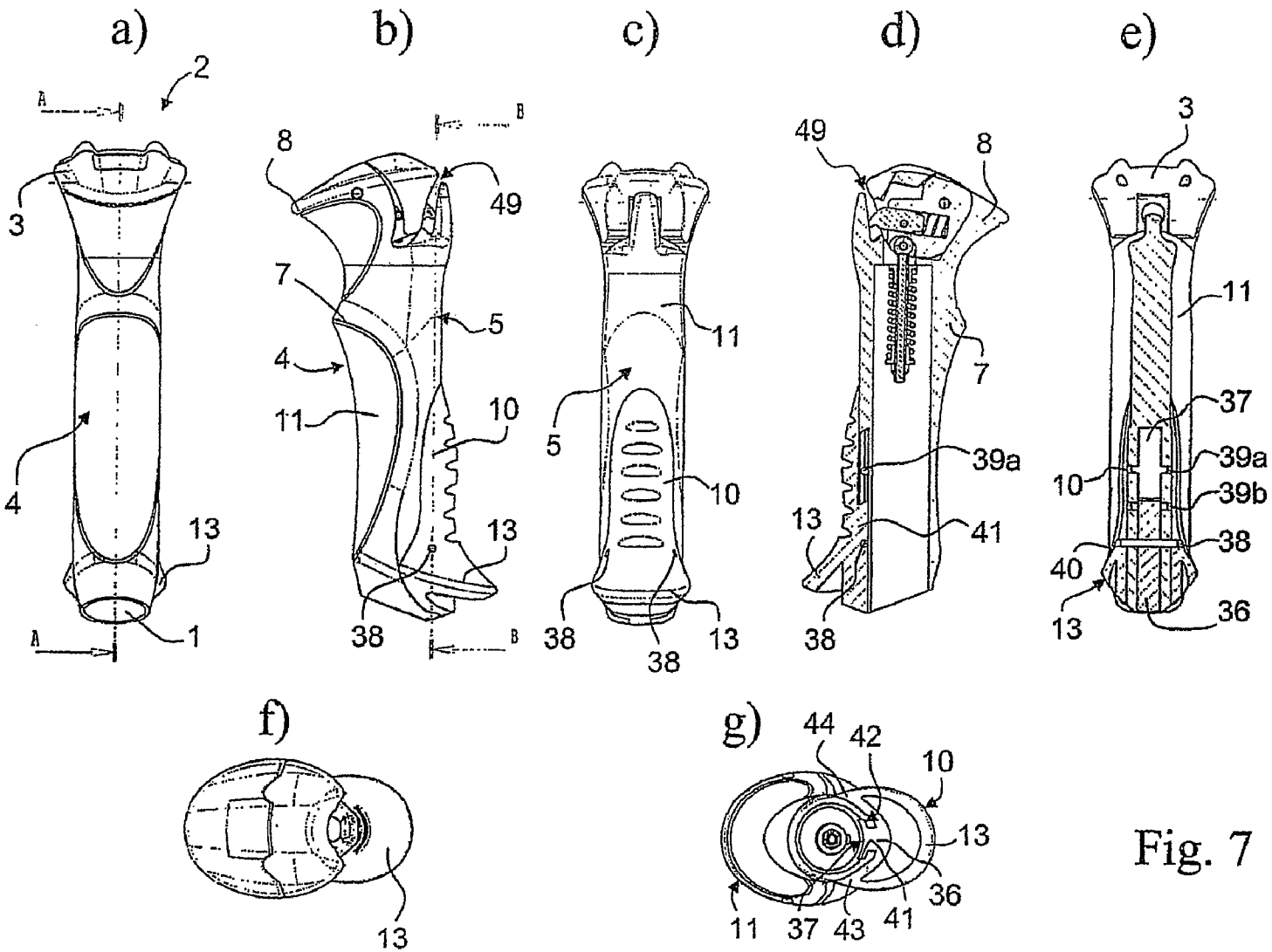
Figure 8:
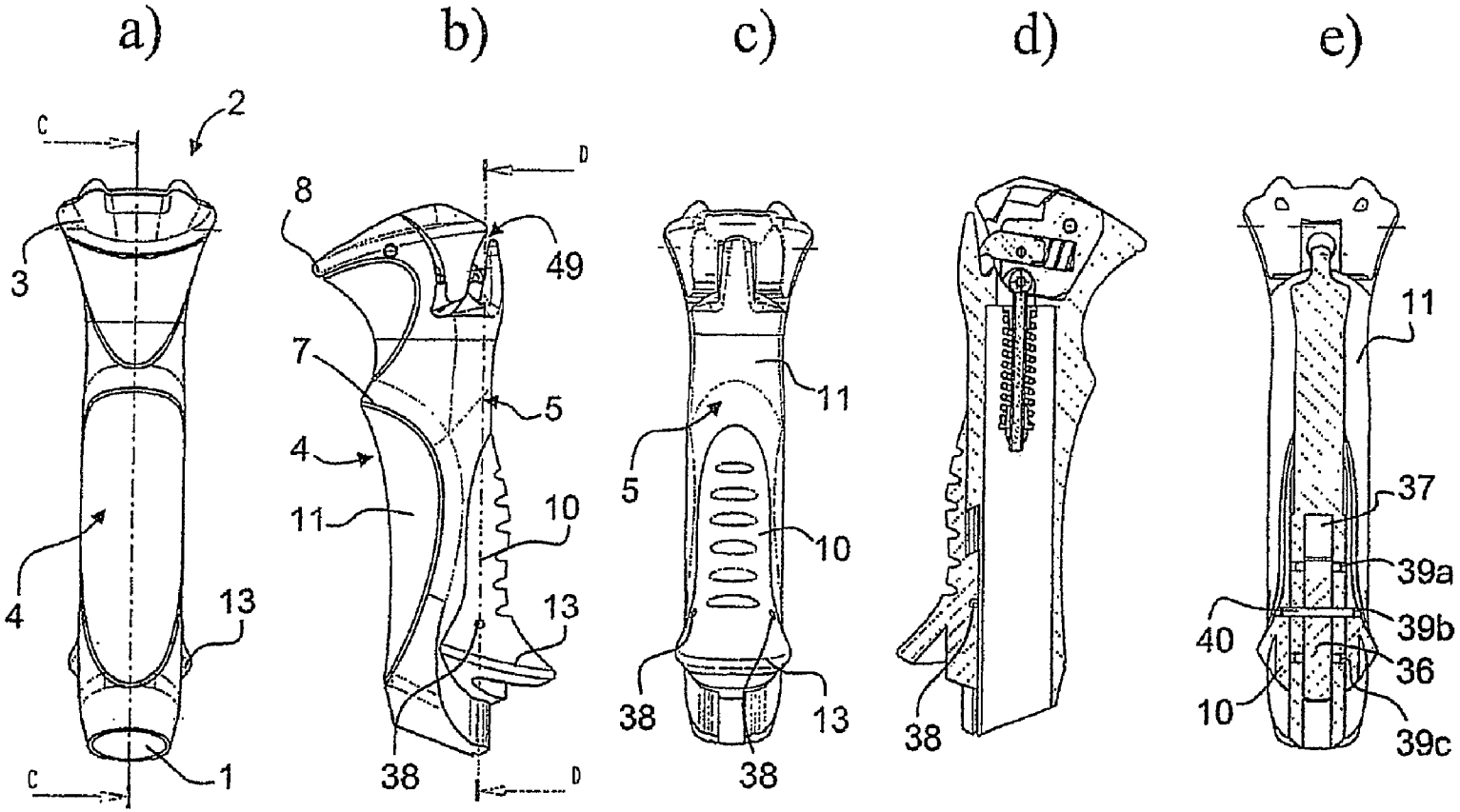
FIG. 8 shows the exemplary embodiment from FIG. 7, wherein the adjustable second pole-grip element is set in the middle position of three possible adjustment positions.
Figure 9:
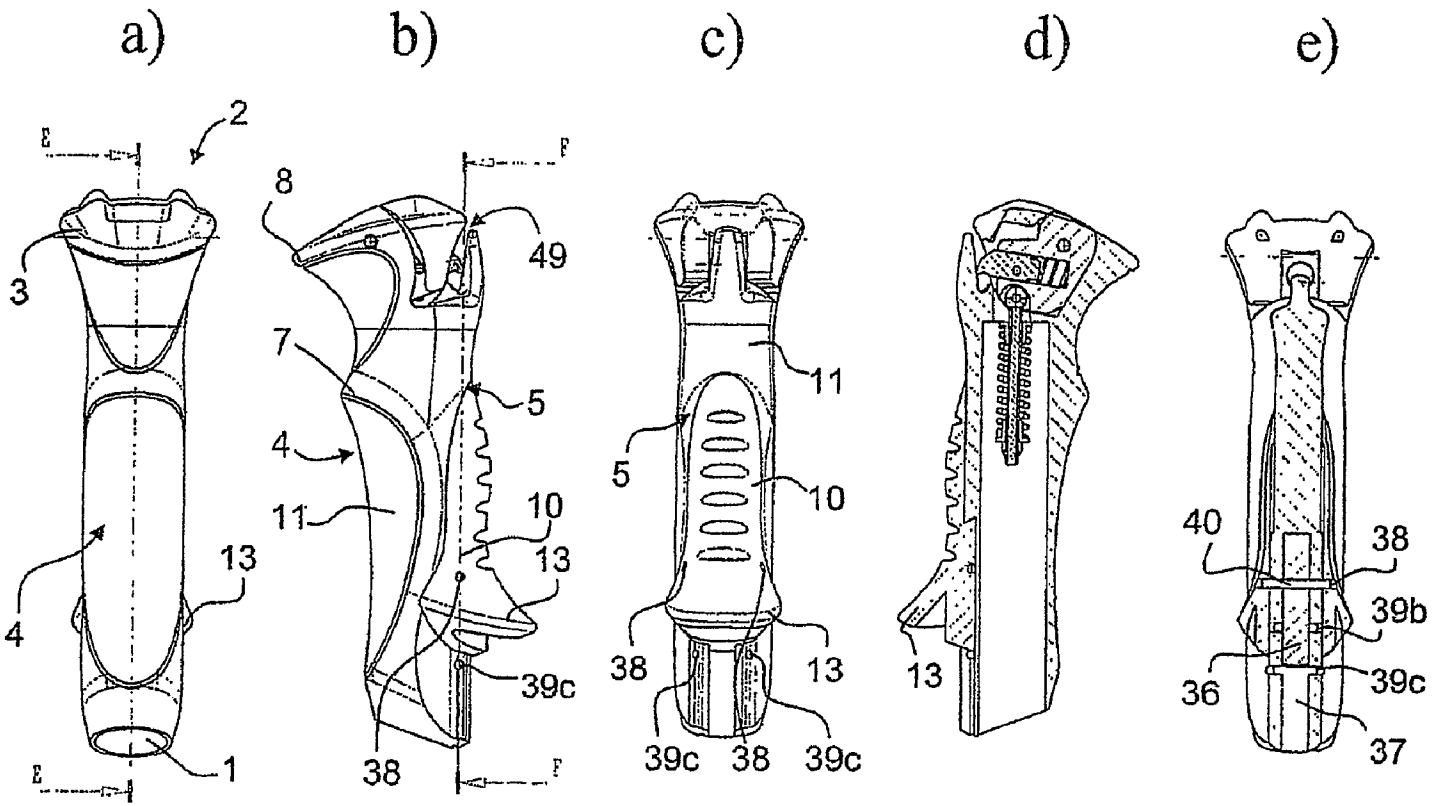
FIG. 9 shows the exemplary embodiment from FIGS. 7 and 8, wherein the adjustable second pole-grip element is set in the lowermost of three possible adjustment positions.

FIGS. 7-9 show an alternative exemplary embodiment of an adjustable pole grip according to the invention with a design similar to that in FIG. 6*b*. The pole grip which is illustrated in FIGS. 7*a*-*c* has, on its rear side, a second pole-grip element 10 which, on the rear side, forms the bottom half of the pole grip and comprises, in particular, the terminating protrusion 13. Arranged on the head of the pole grip is a coupling device 49 for a hand strap, of which the internal elements can be seen in FIGS. 7*d*, 8*d* and 9*d*. It can be seen in FIGS. 7*b*, 8*b* and 9*b* that, in this exemplary embodiment, the second pole-grip element 10 comprises the bottom terminating protrusion 13. At the point where the terminating protrusion 13 begins to project beyond the diameter of the pole grip, a hole 38 is located in the second pole-grip element 10, and this hole is arranged essentially perpendicularly to the pole axis and penetrates twice through the outer wall of the second pole-grip element 10. A transverse pin 40 can be pushed through this hole 38 in order to fasten the second pole-grip element 10 on the first pole-grip element 11 at different axial positions 39*a, b, c*.

It can be seen in FIGS. 7*e*, 8*e* and 9*e* that the first pole-grip element 11, according to this exemplary embodiment, has three holes 39*a, b, c* which are arranged virtually tangentially in three axially offset positions and, like the hole 38 in the second pole-grip element 10 essentially perpendicularly to the pole axis. In FIG. 7, the transverse pin 40 is located in the lowermost of the three holes 39*a, b, c* in the first pole-grip element 11; in FIG. 8, it is located in the middle hole; and in FIG. 9, it is located in the uppermost hole 39*a* in the first pole-grip element 11. It is therefore the case that, in the illustration of FIG. 9, the second pole-grip element 10 is located in the uppermost of the three possible adjustment positions, i.e. suitable for a smaller hand than in FIGS. 7 and 8, wherein, in FIG. 8, the second pole-grip element is set in a middle position and, in FIG. 7, it is set in the lowermost position, i.e. suitable for the largest user hand size in respect of the three possible adjustment positions illustrated. FIG. 7*g* shows, in the view of the pole grip from beneath, how the circumferentially widened axial tongue 36 of the second pole-grip element 10 engages in the axial groove 37 of the first pole-grip element 11, this groove being widened circumferentially by two undercuts 42. The axial tongue 36 of the second pole-grip element 10, this tongue preferably not extending over the entire length of the second pole-grip element 10, has a length of approximately 2 to 6 cm, preferably approximately 2.5 to 5 cm, in particular approximately 2.8 to 4 cm, wherein the width of the axial tongue 36 is approximately 0.3 to 0.9 cm, preferably approximately 0.5 to 0.7 cm, in particular preferably approximately 0.6 cm. The widened portion 41 on the tongue 36 has a width of approximately 0.6 to 1.5 cm, preferably approximately 0.8 to 1.2 cm, in particular preferably approximately 1 cm.

It is preferable, as is illustrated in the view from beneath in FIG. 7*g*, for the second pole-grip element 10 to be designed concavely in the direction of the first pole-grip element 11 on its side which is directed toward the first pole-grip element 11, the second pole-grip element 10 preferably engaging around part of the circumference of the first pole-grip element 11. In this case, the axial tongue 36 of the second pole-grip element 10 is oriented in the direction of the first pole-grip element 11 and has its widened portion 41 engaging in the axial groove 37 of the first pole-grip element 10. The tongue 36, or its widened portion 41, is advantageously introduced from the bottom side of the pole grip 2, where the axial groove 37 is preferably configured to be open toward the bottom.

In the illustration of FIG. 7*g*, the axial tongue 36 with its widened portion 41 is designed essentially with a T-shaped cross section. The crossbar of the letter T here engages in the essentially likewise T-shaped axial groove 37 of the first pole-grip element 11. The T shape of the first pole-grip element 11 or the crossbar of the letter T, respectively, results from the two lateral axial undercuts of the groove 37 in the first pole-grip element 11. Furthermore, the preferably T-shaped tongue 36 advantageously has two wings 43, 44 of the second pole-grip element 10, these wings being visible from above, flanking, or projecting beyond it or engaging around it, respectively, the wings engaging around the region in which the second pole-grip element 10 engages in the first pole-grip element 11. The two wings 43, 44 extend over the entire axial length of the second pole-grip element 10. These two wings 43, 44, each being arranged on one side of the axial tongue 36, provide a continuous transition region from the second pole-grip element 10 to the first pole-grip element 11 in the circumferential direction of the pole grip 2, and this avoids a stepped formation uncomfortable for the user's hand. That side of the second pole-grip element 10 which is directed forward, i.e. is directed toward the first pole-grip element 11, is thus of concave design and preferably has the same curvature as the rearwardly directed outer surface of the first pole-grip element 11.

FIGS. 7*b* and 7*d*, 8*b* and 8*d* and 9*b* and 9*d*, in addition, show an exemplary embodiment of the coupling device 49. As is illustrated, the coupling device 49 can provide a latching-in mechanism for a coupling element of a hand strap, for example by way of a latching nose. It is then possible, in addition, for a release means and various spring mechanisms to be arranged in the interior of the grip head. EP 1 036 579, U.S. Pat. No. 7,226,084, EP 1 282 461 and EP 0 925 099 disclose examples of possible coupling mechanisms which can be used in conjunction with this invention, although other coupling mechanisms are also conceivable. Reference is made, in particular, to the coupling mechanism in WO 2006/066424, of which the subject matter, in particular the disclosure of FIGS. 6 and 7 and of the corresponding passages in the text of the description and claims, is included explicitly in the disclosure content of the present document.

Figure 10:
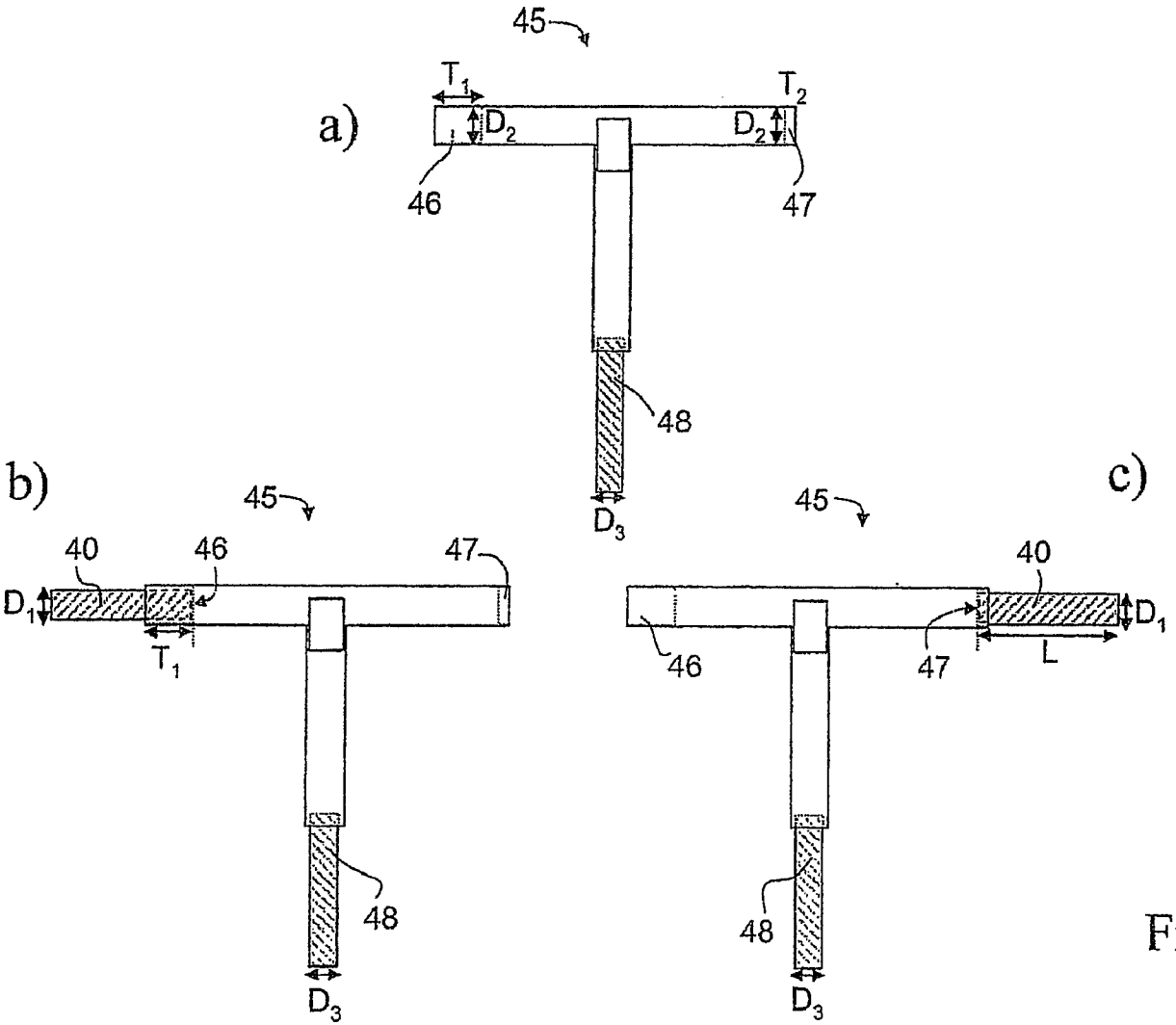
FIG. 10 shows a schematic view of a preferred exemplary embodiment of an adjustment tool for adjusting the length of a pole grip according to the invention.

FIG. 10 illustrates a tool 45 for removing the transverse pin 40 from the pole grip 2 prior to the adjustment of the second pole-grip element 10 and for reintroducing the transverse pin 40 into the pole grip 2 following adjustment. The tool 45 has at least one pin 48, which is suitable for pushing the transverse pin 40 out of the hole 38, 39*a, b, c* in the pole grip 2. The pin 48 preferably has a diameter D3 which is essentially equal to that of the transverse pin 40. In order to release the second pole-grip element 10 from the first pole-grip element 11 and to adjust the size or length of the pole grip 2, in the first instance the transverse pin 40 has to be removed from, or pushed out of, the hole 38, 39*a, b, c*. For this purpose, the pin 48 is positioned coaxially on the transverse pin 40, which, just prior to adjustment, is still located in the hole 38, 39*a, b, c*. Force is then applied in the axial direction of the transverse pin 40, i.e. essentially perpendicularly to the pole axis, in order to push the transverse pin 40 out of the hole 38, 39*a, b, c*. The length of the pin 48 corresponds essentially to the length L of the transverse pin 40, although the pin 48 has to be at least long enough to be able to push the transverse pin 40 out of the hole 38, 39*a, b, c* to the extent where a fraction of the length projecting out can be gripped by the user's fingers in order to remove the transverse pin 40. The tool 45 additionally has, as is illustrated in FIG. 10, at least a first blind hole 46 and a second blind hole 47, which are each suitable for accommodating one end of the transverse pin 40, the first blind hole 46 having a greater depth T1 than the second blind hole 47. The depth T1 of the first blind hole 46 is approximately 0.3-1.2 cm, preferably approximately 0.5-0.9 cm, in particular preferably approximately 0.6-0.8 cm. The depth T2 of the second blind hole 47 corresponds merely to a small fraction of the length L of the transverse pin 40 and is preferably approximately 0.05-0.2 cm, in particular preferably approximately 0.05-0.1 cm, but not more than a fifth of the length L of the transverse pin 40. The two blind holes 46, 47 have a diameter D2 which is larger, but in particular only slightly larger, than the diameter D1 of the transverse pin 40. The two blind holes 46, 47 are intended to make it easier for the user to push the transverse pin 40 into the hole 38, 39*a, b, c* through the second pole-grip element 10 and the first pole-grip element 11. Following the axial adjustment of the second pole-grip element 10 on the first pole-grip element 11, the transverse pin 40 is inserted horizontally, i.e. transversely to the pole axis, in the first instance into the deeper, first blind hole 46 and is introduced into the pole grip 2 through the desired hole 39. The tool 45 is used in order to push the pin into the hole. The first blind hole 46 allows a first fraction of the length L of the transverse pin 40 to be pushed in until for example approximately half, preferably a fifth to a third, of the length L of the transverse pin 40 is located in the pole grip. The remaining fraction of the length of the transverse pin 40 can then be pushed essentially all the way into the pole grip with the aid of the second blind hole 47 of the tool 45, in which case the tangential hole is essentially filled by the transverse pin 40 in a horizontal position. It is possible, however, for that fraction of the length of the transverse pin 40 which was mounted in the second blind hole 47, and corresponds to the depth of the second blind hole 47, still to remain outside the hole 38, 39*a, b, c*. This remaining fraction can then be pushed in with the aid of a planar surface of the tool 45. The tool illustrated in FIG. 10 is essentially T-shaped, the two "arms" of the crossbar each having a blind hole 46, 47 and the pin 48 being arranged on the "foot" of the letter T. Other arrangement variants, however, are also conceivable. The blind holes 46, 47 and the pin 48 could, for example, also be arranged in a line or along a circle shape on the tool 45 or the tool 45 could have three arms which are suitable for accommodating the blind holes 46, 47 and the pin 48 and are oriented in different directions. The tool may be configured in different colors and/or shapes, for example in the form of an airplane, wherein the two wings of the airplane each have a blind hole 46, 47 and the pin 48 is arranged at the head or tail of the airplane.

LIST OF DESIGNATIONS

1 Recess for pole shaft
2 Pole grip
3 Head region of 2
4 Front side of 2
5 Rear side of 2
6 Front grip region for middle finger, ring finger and little finger
7 Rib/protrusion between 6 and 9
8 Top terminating rib, top terminating protrusion, front
9 Front grip region for forefinger
10 Variable and/or displaceable pole-grip element
11 Pole-grip element fixed on the pole shaft
12 Top terminating rib, top terminating protrusion, rear
13 Bottom terminating rib, bottom terminating protrusion, rear
14 Bottom terminating rib, bottom terminating protrusion, front
15 Axial screw
16 Adjusting nut
17 Aperture in 10 for 16
18 Cavity
19 Recess for hand strap or hand-strap mechanism
20 Guide groove in 11
21 Guide rib on 10
22 Top covering region of 10
23 Ventilation holes
24 Screw head
25 Fixing clamp
26 Top guide hole in 15
27 Bottom guide of 15
28 Threaded region of 10
29 Fixing screw
30 Square mating nut in respect of 29
31 Guide recess for 30
32 Screw head of 29
33 Toothing formation in 10
34 Toothing formation in 11
35 Individual mating nut for discrete positions
36 Axial tongue
37 Axial groove
38 Hole in 36 of 10
39 Hole for 40 in 11
39*a* First hole for 40 in 11
39*b* Second hole for 40 in 11
39*c* Third hole for 40 in 11
40 Transverse pin
41 Widened portion on 36
42 Undercut of 37
43 First wing of 10
44 Second wing of 10
45 Tool
46 First blind hole in 45
47 Second blind hole in 45
48 Pin in 45
49 Coupling device
D1 Diameter of 40
D2 Diameter of 46, 47
D3 Diameter of 48
T1 Depth of 46
T2 Depth of 47
L Length of 40

The invention claimed is:

1. A pole grip for an alpine- or cross-country ski pole, hiking pole or Nordic walking pole having a pole shaft, said pole grip comprising:

a grip body which, on at least a forwardly directed side that is directed forward as seen in a movement direction, or on a rearwardly directed side that is directed rearward as seen in the movement direction, has, in a head region, a top terminating protrusion which, when a user grips the pole grip, is arranged above a gripping hand and adjacent to the gripping hand and, at least on the rearwardly directed side, the grip body has a bottom rearwardly directed terminating protrusion which, when the user grips the pole grip, is arranged beneath the gripping hand and adjacent to the gripping hand, wherein the grip body comprises at least two individual pole-grip elements, a first pole-grip element that is connected to the pole shaft in a form-fitting and/or force-fitting manner, such that no movement can take place, and a second pole-grip element is arranged on the first pole-grip element such that it can be displaced and secured or exchanged, thereby allowing adaptation to different hand sizes, wherein the first pole-grip element forms the head region and the forwardly directed side, and the second pole-grip element is arranged on the rearwardly directed side, and wherein the second pole-grip element comprises the bottom, rearwardly directed terminating protrusion.

2. The pole grip as claimed in claim 1, wherein the second pole-grip element forms, at least in part, the rearwardly directed grip region of the pole grip.

3. The pole grip as claimed in claim 1, wherein the second pole-grip element is mounted such that it can be displaced, or secured in discrete positions, in relation to the first pole-grip element in a direction essentially parallel to the main axis of the pole grip.

4. A pole grip, in particular for an alpine- or cross-country ski pole, hiking pole or Nordic walking pole having a pole shaft, comprising:

a grip body which, on at least a forwardly directed side, which is directed forward as seen in a movement direction, or a rearwardly directed side, which is directed rearward as seen in the movement direction, has, in a head region, a top terminating protrusion which, when a user grips the pole, is arranged above a gripping hand and adjacent to the gripping hand and, at least on the rearwardly directed side, the grip body has a bottom terminating protrusion which, when the user grips the pole, is arranged beneath the gripping hand and adjacent to the gripping hand, wherein the grip body is constructed from at least two individual pole-grip elements, a first pole-grip element that is connected to the pole shaft in a form-fitting and/or force-fitting manner, such that no movement can take place, and a second pole-grip element that is arranged on the first pole-grip element such that it can be displaced and secured or exchanged, thereby allowing adaptation to different hand sizes, wherein the second pole-grip element is mounted such that it can be displaced, or secured in different discrete axial positions, in relation to the first pole-grip element in a direction essentially parallel to the main axis of the pole grip and wherein the position of the second pole-grip element relative to the first pole-grip element can be secured via at least one transverse pin, the at least one transverse pin being mounted in a transverse through hole in at least one of the first pole-grip element or the second pole-grip element.

5. The pole grip as claimed in claim 4, wherein the first pole-grip element has an axial tongue and the second pole-grip element has a corresponding axial groove, or wherein the first pole-grip element has an axial groove and the second pole-grip element has a corresponding axial tongue, and wherein the axial tongue contains, at different heights, at least two holes or apertures through which the transverse pin passes, in doing so securing the axial position of the second pole-grip element.

6. The pole grip as claimed in claim 4, wherein the first pole-grip element has an axial groove and the second pole-grip element has a corresponding axial tongue, and wherein the axial groove has at least one additional undercut and the axial tongue has at least one additional widened portion.

7. The pole grip as claimed in claim 4, wherein the axial groove of the first pole-grip element is open in the downward direction and is suitable for accommodating an axial tongue arranged at least in a bottom region of the second pole-grip element.

8. The pole grip as claimed in claim 5, wherein in a region which bounds the axial groove laterally, the first pole-grip element has at least two axially offset holes as through-holes for the transverse pin, and wherein the second pole-grip element has a tangential hole which, when the second pole-grip element is positioned at the desired adjustment height, ends up located over one of the tangential holes of the first pole-grip element.

9. The pole grip as claimed in claim 7, wherein the transverse pin, which is inserted when the second pole-grip element has been placed in position, projects twice through the first pole-grip element and three times through the second pole-grip element, wherein, in the second pole-grip element, the transverse pin projects once through the axial tongue, and wherein the second pole-grip element has two wings which at least partially engage around the first pole-grip element, wherein a side of the second pole-grip element which is directed toward a rearwardly directed side of the first pole-grip element is of concave design and has essentially the same curvature as the rearwardly directed side of the first pole-grip element.

10. The pole grip as claimed in claim 1, wherein the second pole-grip element is mounted such that it can be displaced via an adjusting screw mounted in the first pole-grip element, wherein the adjusting screw is arranged essentially axially in relation to the axis of the pole grip and comprises a screw of which it is not possible to change the axial position within the first pole-grip element, and wherein arranged on or in the second pole-grip element is a threaded element which runs on the thread of this screw and may be formed integrally with the second pole-grip element or may be in the form of a separate component.

11. The pole grip as claimed in claim 10, wherein the screw is arranged in a rotationally fixed manner in the first pole-grip element, and wherein the threaded element is an adjusting nut, which is arranged in or on the second pole-grip element such that it can be rotated but is fixed axially relative to the second pole-grip element, wherein, when the adjusting nut is rotated, there is a change in the axial position of the second pole-grip element relative to the first pole-grip element, and wherein the adjusting nut is accessible from the outside in that region on which the palm of the hand ends up to be located.

12. The pole grip as claimed in claim 10, wherein the screw is arranged in a rotatable manner in the first pole-grip element, and wherein the threaded element is a rotationally fixed thread in the second pole-grip element, it being possible for this rotationally fixed thread to be in the form of a separate component or to be formed in the material of the second pole-grip element, wherein, when the screw is rotated, there is a change in the axial position of the second pole-grip element, relative to the first pole-grip element, and wherein the screw is accessible from the bottom beneath the second pole-grip element.

13. A pole grip, in particular for an alpine- or cross-country ski pole, hiking pole or Nordic walking pole having a pole shaft, comprising:

a grip body which, on at least a forwardly directed side, which is directed forward as seen in the movement direction, or a rearwardly directed side, which is directed rearward as seen in the movement direction, has, in a head region, a top terminating protrusion which, when a user grips the pole, is arranged above a gripping hand and adjacent to the gripping hand and, at least on the rearwardly directed side, the grip body has a bottom terminating protrusion which, when the user grips the pole, is arranged beneath the gripping hand and adjacent to the gripping hand, wherein the grip body is constructed from at least two individual pole-grip elements, a first pole-grip element that is connected to the pole shaft in a form-fitting and/or force-fitting manner, such that no movement can take place, and a second pole-grip element that is arranged on the first pole-grip element such that said second pole-grip element can be displaced and secured or exchanged, thereby allowing adaptation to different hand sizes, wherein the second pole-grip element can be secured in different axial positions in relation to the first pole-grip element via at least one fixing screw which is arranged essentially perpendicularly in relation to the main axis of the pole grip and passes through a hole through the second pole-grip element, wherein the first pole-grip element contains an essentially axially oriented guide recess in which at least one mating nut is mounted in an axially displaceable but rotationally fixed manner, and wherein the at least one fixing screw engages in said at least one mating nut.

14. The pole grip as claimed in claim 13, wherein the first pole-grip element contains at least two discretely positioned mating threads for the fixing screw, such that the second pole-grip element can be secured in discrete axial positions.

15. The pole grip as claimed in claim 13, wherein the first pole-grip element and the second pole-grip element have a toothing formation, and these toothing formations, by engaging one inside the other, enhance the axial securing action of the two elements in relation to one another.

16. The pole grip as claimed in claim 1, wherein the first pole-grip element forms the head region and the forwardly directed region, and the second pole-grip element is arranged on the side, which is directed rearward as seen in the movement direction, wherein the second pole-grip element comprises the bottom, rearwardly directed terminating protrusion, wherein the second pole-grip element forms, at least in part, the rearwardly directed grip region of the pole grip, and wherein the first pole-grip element has axially running lateral guide grooves, and the second pole-grip element has corresponding guide ribs which engage in these guide grooves.

17. A pole grip, in particular for an alpine- or cross-country ski pole, hiking pole or Nordic walking pole having a pole shaft, comprising:

a grip body which, on at least a forwardly directed side, which is directed forward as seen in the movement direction, or a rearwardly directed side, which is directed rearward as seen in the movement direction, has, in a head region, a top terminating protrusion which, when a user grips the pole, is arranged above a gripping hand and adjacent to the gripping hand and, at least on the rearwardly directed side, the grip body has a bottom terminating protrusion which, when the user grips the pole, is arranged beneath the gripping hand and adjacent to the gripping hand, wherein the grip body is constructed from at least two individual pole-grip elements, a first pole-grip element that is connected to the pole shaft in a form-fitting and/or force-fitting manner, such that no movement can take place, and a second pole-grip element is arranged on the first pole-grip element such that it can be displaced and secured or exchanged, thereby allowing adaptation to different hand sizes, wherein the first pole-grip element forms the bottom region of the pole grip and has at least the bottom terminating protrusion, and wherein the second pole-grip element forms the top region of the pole grip and has at least the top terminating protrusion.

18. The pole grip as claimed in claim 1, wherein the second pole-grip element is designed to be exchangeable and can be fitted in different colors or materials or external shapes.

19. The pole grip as claimed in claim 1, wherein at least one of the first pole-grip element or the second pole-grip element consists of a plastic material, cork or wood or a combination of these materials.

20. The pole grip as claimed in claim 1, wherein the pole grip has, in the head region, at least one coupling element for fastening a hand strap in a releasable manner.

21. The pole grip as claimed in claim 6, wherein both the axial groove and the axial tongue are essentially T-shaped.

22. The pole grip as claimed in claim 7, wherein the axial groove of the first pole-grip element is suitable for accommodating the axial tongue from beneath.

* * * * *